US009689137B2

(12) United States Patent
Matson

(10) Patent No.: US 9,689,137 B2
(45) Date of Patent: Jun. 27, 2017

(54) TRENCHING SHOVEL

(71) Applicant: Ronald Lee Matson, Duluth, MN (US)

(72) Inventor: Ronald Lee Matson, Duluth, MN (US)

( * ) Notice: Subject to any disclaimer, the term of this patent is extended or adjusted under 35 U.S.C. 154(b) by 0 days.

(21) Appl. No.: 15/048,364

(22) Filed: Feb. 19, 2016

(65) Prior Publication Data

US 2016/0353650 A1 Dec. 8, 2016

Related U.S. Application Data

(60) Provisional application No. 62/170,839, filed on Jun. 4, 2015.

(51) Int. Cl.

| | |
|---|---|
| ***A01B 1/16*** | (2006.01) |
| ***A01D 9/06*** | (2006.01) |
| ***A01D 11/00*** | (2006.01) |
| ***E02F 3/02*** | (2006.01) |
| ***E02F 5/10*** | (2006.01) |

(52) U.S. Cl.
CPC . *E02F 3/02* (2013.01); *E02F 5/10* (2013.01)

(58) Field of Classification Search
CPC ..... A01B 1/02; E02F 3/02; E02F 5/10
USPC ..... 294/49; D7/691
See application file for complete search history.

(56) References Cited

U.S. PATENT DOCUMENTS

| | | | | |
|---|---|---|---|---|
| 884,416 | A * | 4/1908 | Poindexter | A01G 3/06 172/13 |
| 1,635,308 | A * | 7/1927 | Botsford | A01B 1/028 294/49 |
| 4,904,011 | A * | 2/1990 | Hawk | A01B 1/02 294/49 |
| 5,209,534 | A * | 5/1993 | Crenshaw | A01C 5/02 172/22 |
| 5,520,429 | A * | 5/1996 | Gregory | A01B 1/02 254/131.5 |
| 5,791,707 | A * | 8/1998 | Szakurski | A01B 1/225 294/51 |
| 6,012,748 | A * | 1/2000 | Franks | E01H 1/1206 294/1.4 |
| 2003/0222417 | A1* | 12/2003 | Ouellette | B62B 13/18 280/9 |
| 2011/0037281 | A1* | 2/2011 | Cox | A01B 1/02 294/49 |

* cited by examiner

*Primary Examiner* — Stephen Vu
(74) *Attorney, Agent, or Firm* — Dunlap Bennett & Ludwig PLLC

(57) ABSTRACT

The trenching shovel is narrow at its digging end so that a lot less dirt is required to be removed. The trenching shovel has a three sided blade and the shovel point has a concave, sharp edge which partially wraps around a root to permit cutting of the root without the blade slipping off. The three sides are also angled slightly outward to help prevent dirt from sticking to the channel of the shovel and to compact the side edges of the trench to prevent collapse of the sidewalls into the formed trench.

15 Claims, 4 Drawing Sheets

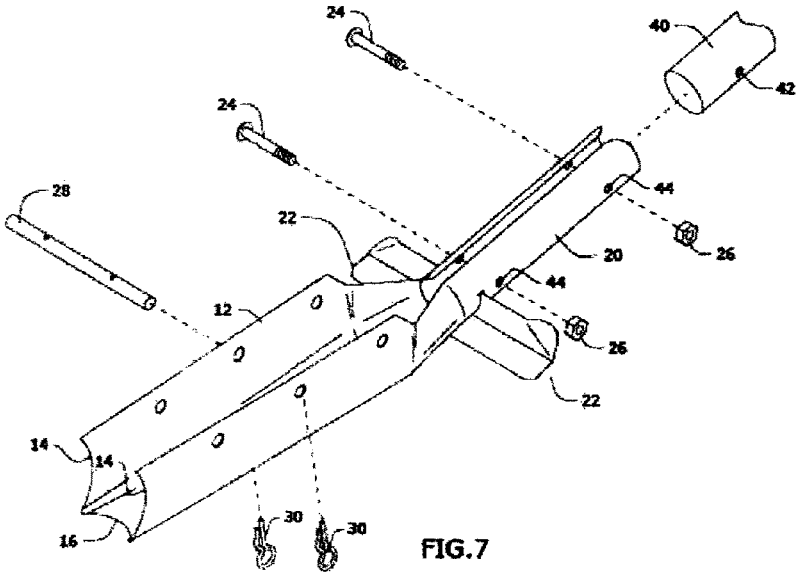
FIG.7
FIG. 8
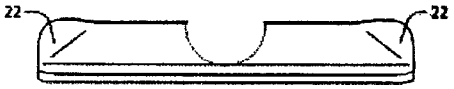

TRENCHING SHOVEL

CROSS-REFERENCE TO RELATED APPLICATION

This application claims the benefit of priority of U.S. provisional application No. 62/170,839, filed Jun. 4, 2015, the contents of which are herein incorporated by reference.

BACKGROUND OF THE INVENTION

The present invention relates to shovels and, more particularly, to shovels for digging trenches for burying of items such as cable, wiring, piping and the like under the surface of the ground.

Prior to this invention, digging a trench (twelve inches deep) to bury wires or piping usually required the removal of a substantial of extra dirt and cutting through root systems. Narrow bladed shovels in the art are known, however, these shovels still present challenges in their abilities at removing excavated dirt from within the formed trench and do not maintain the sidewalls of the trench. Moreover, these shovels still encounter the same limitations in their ability to cut through subterranean roots.

As can be seen, there is a need for a trenching shovel that is narrower so a lot less dirt is removed. Each of the three sides of the shovel point has a concave, sharp edge which partially wraps around a root without slipping off. The three sides are also angled slightly outward to help prevent dirt from sticking to the channel of the shovel.

SUMMARY OF THE INVENTION

In one aspect of the present invention, a trenching shovel includes an elongated handle operatively attached to a shovel head, the shovel head having a left and a right upturned sidewall extending from an aft sidewall and defining a trenching channel therein. The trenching shovel may also include a depth guide having opposed apertures defined in the left and the right side wall; and a depth guide pin extending through the opposed apertures. The trenching shovel may also include a concave edge surface defined in a ground penetrating edge of the left and right upturned sidewalls. A concave edge surface may also be defined in a ground penetrating edge of the aft sidewall. The concave edge surface may also be a sharpened edge. A foot bar may extend laterally across the shovel head proximal to an attachment end of the shovel head and the foot bar may also be provided with an upturned end portion.

In other aspects of the invention, the aft sidewall is outwardly tapered between a ground penetrating tip and an area proximal to a handle attachment end. The lateral sidewalls are configured to taper outwardly along the lateral aspects of the aft sidewall. The aft sidewall of the trenching shovel may also be angled with respect to the handle towards an opening of the trenching channel.

In yet other aspects of the invention a trenching shovel has a handle; a shovel head operatively coupled to the handle; and a trenching channel formed in the shovel head, the trenching channel having a ground penetrating end distal from the handle. The trenching channel may be defined wherein a left and a right sidewall taper outwardly from the ground penetrating end to an end proximal to the handle. A concave edge surface can be defined in the ground penetrating end of the trenching channel. The trenching shovel may also have an adjustable depth guide pin operatively received in opposed apertures defined in the left and right sidewalls. A foot bar is operatively attached to the blade head proximal to the handle.

These and other features, aspects and advantages of the present invention will become better understood with reference to the following drawings, description and claims.

BRIEF DESCRIPTION OF THE DRAWINGS

FIG. 7 is an exploded view of the trenching shovel head.

FIG. 8 is a detail view of a foot bar.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a narrow head trenching shovel which provides efficient digging by limiting the removal of dirt to no more than is necessary. The trenching shovel still allows the trench to be wide enough for piping or cables to be buried.

As stated above, prior to the present invention, digging a trench (twelve inches deep) to bury wires, cables or piping usually required the removal of a lot of extra dirt and presented the extra difficulty of cutting through root systems.

Figure 1:
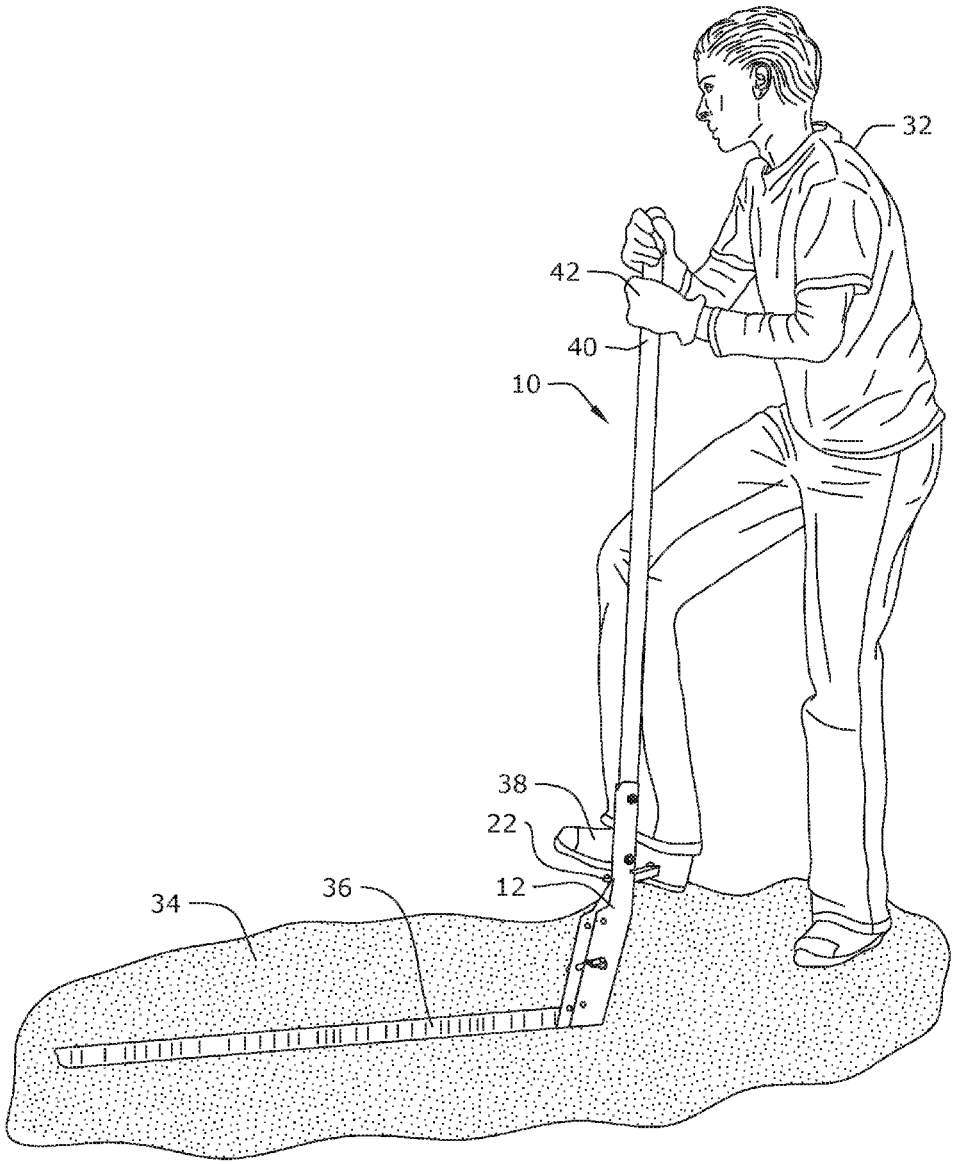
FIG. 1 is a perspective view of an embodiment of a trenching shovel shown in use.
Figure 2:
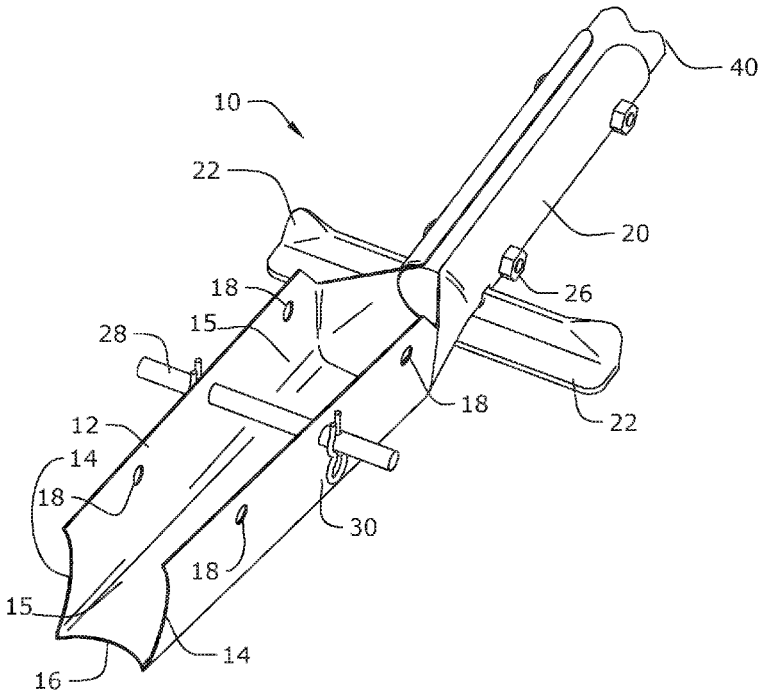
FIG. 2 is a top perspective detail view of the trenching shovel head.
Figure 3:
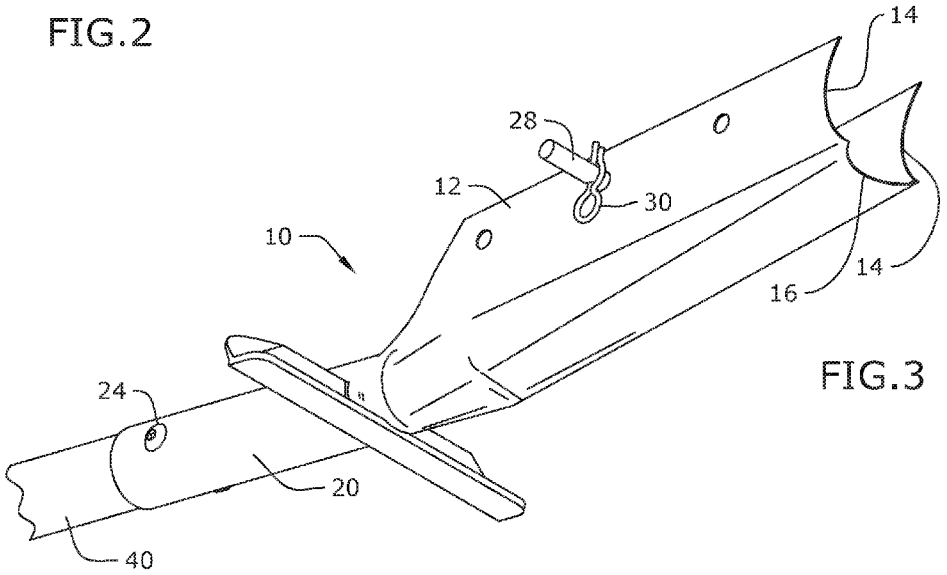
FIG. 3 is a bottom perspective detail view of the trenching shovel head.
Figure 4:
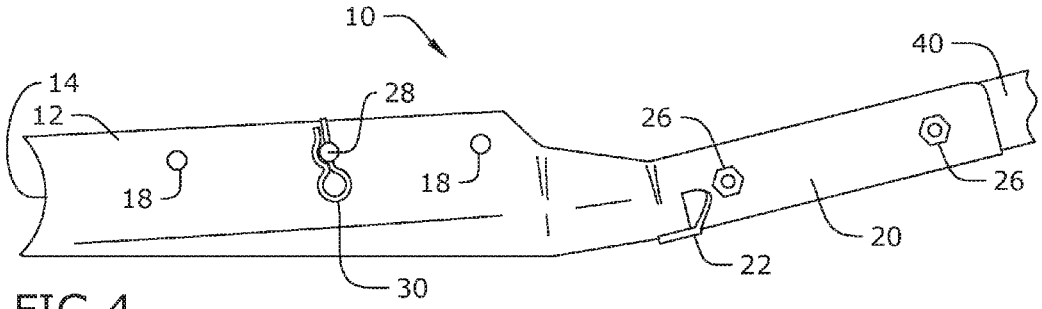
FIG. 4 is a side detail view of the trenching shovel head.
Figure 5:
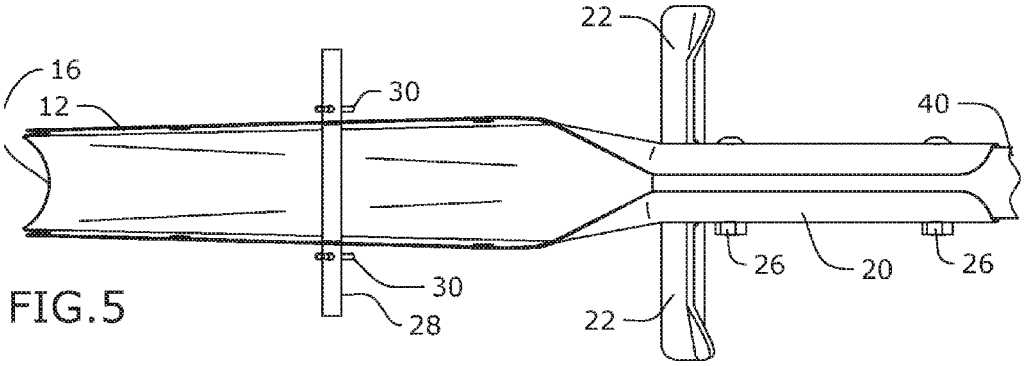
FIG. 5 is a top view of the trenching shovel head.
Figure 6:
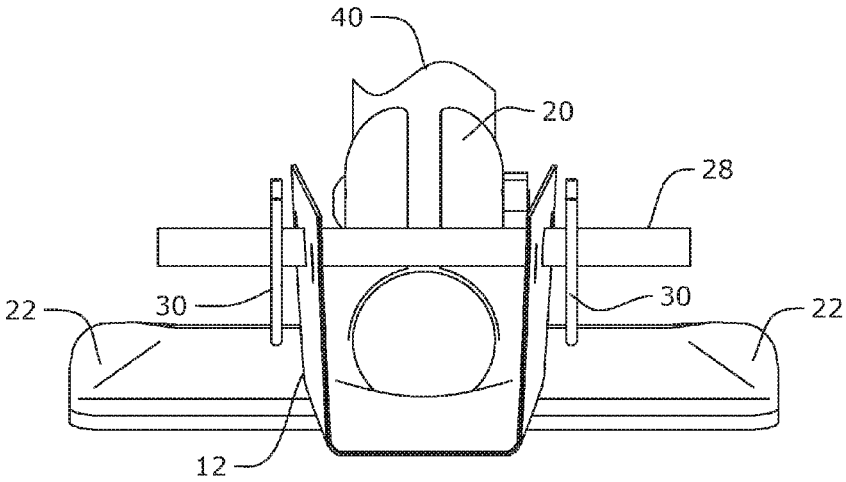
FIG. 6 is a front view of the trenching shovel.

As seen in reference to FIG. 1 an embodiment of a trenching shovel 10 according to the present invention is illustrated. The trenching shovel 10 has a head 12 disposed at the end of an elongate handle 40. The head 12 may have at least one foot bar 22 extending laterally from a longitudinal length of the shovel 10.

A user 32 grasps the handle 40 with their hands 42 to work the head 12 into a ground surface 34 to dig a trench 36. The user 32 may apply their foot 38 to the at least one foot bar 22 to apply additional force to drive the shovel head 12 into the ground surface 34 to dig the soil and form the trench 36.

As seen in the drawings of the trenching shovel head 12 shown in FIGS. 2-7, the shovel head 12 is formed by a left and a right upturned sidewalls separated by an aft sidewall to define a trenching channel 15. The shovel head 12 may be formed from any suitable material, and is preferably selected from a 14 gauge tempered steel.

The left and right sidewalls may have a forward curvilinear ground penetrating edge surfaces 14 that extend from an upper corner of the sidewalls to their juncture with the aft sidewall. Likewise, the aft sidewall may also include a forward curvilinear ground penetrating edge surface 16 that extends between the juncture with the left and right sidewalls. The curvilinear surfaces are preferably concave into the lateral aspects of sidewalls to define opposed root securing points. Preferably, the forward edge surfaces 14 & 16 have a sharpened blade edge.

The concave surfaces are configured, such that upon engagement of the edges 14 & 16 with the ground neatly slices the sides of the trench, any overlying area of sod, and roots that may be encountered. The edges 14 & 16 contain the root so that the root may be cut by the sharpened blade edge. With the sharpened blade edges 14 in the upturned sidewalls, roots running laterally across the trench 36 may be cut, while leaving the sides of the trench intact. The concave, blade edge design on the three sidewalls ensures a good grip on a root system without the shovel head slipping off.

The spacing between the upturned sidewalls may be selected based on a desired width of the trench. In application, the inventor has found that a spacing of about 2½ inches in width provides efficient digging by limiting removal of any more dirt than necessary. It is also allows the resultant trench to be wide enough for small diameter piping or cables to be buried.

The sidewalls may have a length of approximately 14 inches. The aft sidewall may have a gradually tapered width beginning at the concave edge 16 and extending outwardly towards a head attachment end 20. With the left and right sidewalls formed along the tapered edge the channel has a narrowed opening at the ground penetrating end and opens to a widened area proximal to the head attachment 20. The tapered left and right sidewalls serve to pack the sidewalls of the formed trench outwardly so as to prevent collapsing of the trench sidewalls. The expanded region of the channel proximal to the head end also permits the excavation of a greater volume of dirt with each lift.

In forming a trench 36, it is often desirable that the trench 36 have a uniform, or minimum depth beneath the ground surface 34. As such, the trenching shovel 10 of the present invention may also include an adjustable depth gauge, which is formed by a depth guide pin 28 extending between opposed apertures 18 defined in the left and right sidewalls. The depth guide pin 28 may be retained within the opposed apertures by any suitable means, such as by a hitch pin 30. The opposed apertures 18 may be defined in a spaced apart relation along the longitudinal length of the sidewalls. The opposed apertures 18 may be at a fixed spacing, or at a spacing to correspond to minimum burial depths specified by local building codes for buried cables and piping. In a preferred embodiment, three holes are drilled on each of the two sidewalls of the shovel head to hold the depth controlling pin in place at the 4", 8" or 12" positions.

As previously indicated, the sidewalls of the shovel head 12 are configured to terminate proximal to the head attachment end 20 of the shovel head 12. The head attachment end 20 may be formed as a generally cylindrical shape to wrap around the shovel handle 40 or otherwise form a socket to receive the handle 40. The handle 40 may be formed from any suitable material, such as wood, fiberglass or metal. In a preferred embodiment the handle 40 is on the order of about 3½ feet long. The head may be secured to the handle by any suitable fasteners, such as nuts and bolts, rivets, welds, or adhesives.

The foot bar 22 may be attached to the shovel head 12 by any suitable means. As seen in reference to FIGS. 3 and 4, the foot bar 22 may be welded to the head attachment 20. The foot bar 22 may also include upturned ends to assist with retaining the user's foot 38 on the foot bar 22. The foot bar 22 may be formed from any suitable material, and is preferably formed from a 1 inch×6 inch piece of angle iron with a half circle portion cut out (refer to FIG. 8) of the angle iron, which radius coincides with the radius of the outside cylindrical head attachment 20, then welded in proper place.

As will be appreciated, the angle iron foot-bar 22 could be eliminated if the shovel head 12 could be forged to include the shaping of the foot-bar 22 in one piece construction.

In use, the user 32 could mark on the ground with spray paint, etc. where the trench 36 will be dug. The user 32 would start by digging a small starter hole and then simply follow the marked line. To utilize the tapered sidewall configuration to its best advantage, the user 32 should dig by facing the starting hole and thrust their foot 38 down on the foot-bar 22, digging a longitudinal length of about three inches of dirt at a time. If ground conditions permit a depth of 12-14 inches in depth may be dug if desires at each scoop. The user 32 would continue digging as needed to obtain a trench 36 of the desired length and utilizing the depth guide pins 18, to the desired depth.

It should be understood, of course, that the foregoing relates to exemplary embodiments of the invention and that modifications may be made without departing from the spirit and scope of the invention as set forth in the following claims.

What is claimed is:

1. A trenching shovel comprising:

an elongate handle operatively attached to a shovel head, the shovel head having a left and a right upturned sidewall extending from a front end of the shovel head to an aft end of the shovel head along a generally planar aft sidewall defining a substantially rectangular shaped trenching channel therein:

left and right concave edge surfaces respectively defined at a forward ground penetrating end of the respective left and the right upturned sidewalls; and an aft concave edge surface defined at a forward ground penetrating end of the aft sidewall and situated between the left and the right concave edge surfaces.

2. The trenching shovel of claim 1, further comprising:

a depth guide having a plurality opposed apertures defined in the left and the right upturned sidewalls; and a depth guide pin selectably positioned through the opposed apertures.

3. The trenching shovel of claim 1, wherein the left and right concave edge surfaces define opposed root securing points at the forward ground penetrating end of the left and right upturned sidewalls.

4. The trenching shovel of claim 3, wherein the aft concave edge surface defines opposed root securing points at the forward ground penetrating end of the aft sidewall.

5. The trenching shovel of claim 4, wherein the left, right, and aft concave edge surfaces are sharpened.

6. The trenching shovel of claim 1, further comprising:

a foot bar extending laterally across the shovel head proximal to an attachment end of the shovel head.

7. The trenching shovel of claim 6, wherein the foot bar has an upturned end portion.

8. The trenching shovel of claim 1, wherein the aft sidewall is outwardly tapered between a ground penetrating tip and an area proximal to a handle attachment end.

9. The trenching shovel of claim 8, wherein the left and right upturned sidewalls taper outwardly along a lateral aspect of the aft sidewall between the ground penetrating tip and the area proximal to the handle attachment end.

10. The trenching shovel of claim 9, wherein the aft sidewall is angled with respect to the handle towards an opening of the trenching channel.

11. A trenching shovel comprising:

a handle;

a shovel head operatively coupled to the handle;

a substantially box shaped trenching channel formed in the shovel head, the trenching channel having a generally planar aft sidewall disposed between left upturned sidewall and a right upturned sidewall, a ground penetrating end distal from the handle; and a concave edge surface defined in a forward ground penetrating end of each of the left and the right upturned sidewalls, and the aft sidewalls.

12. The trenching shovel of claim 11, wherein left and right sidewalls of the trenching channel taper outwardly from the ground penetrating end to an end proximal to the handle.

13. The trenching shovel of claim 12, wherein the concave edge surfaces are defined between root securing points formed in the ground penetrating end of the trenching channel.

14. The trenching shovel of claim 13, further comprising:

an adjustable depth guide pin operatively received in a plurality of opposed aperture defined in the left and right upturned sidewalls.

15. The trenching shovel of claim 14, further comprising:

a foot bar operatively attached to the shovel head proximal to the handle.

* * * * *